US009322510B2

(12) United States Patent
Weickert et al.

(10) Patent No.: US 9,322,510 B2
(45) **Date of Patent: *Apr. 26, 2016**

(54) METHOD OF CHARGING A SORPTION STORE WITH A GAS

(71) Applicant: BASF SE, Ludwigshafen (DE)

(72) Inventors: Mathias Weickert, Ludwigshafen (DE); Stefan Marx, Dirmstein (DE); Ulrich Müller, Neustadt (DE); Peter Renze, Mannheim (DE)

(73) Assignee: BASF SE, Ludwigshafen (DE)

( * ) Notice: Subject to any disclaimer, the term of this patent is extended or adjusted under 35 U.S.C. 154(b) by 119 days.

This patent is subject to a terminal disclaimer.

(21) Appl. No.: 14/048,358

(22) Filed: Oct. 8, 2013

(65) Prior Publication Data

US 2014/0097100 A1 Apr. 10, 2014

Related U.S. Application Data

(60) Provisional application No. 61/711,233, filed on Oct. 9, 2012.

(51) Int. Cl.
*F17C 11/00* (2006.01)

(52) U.S. Cl.
CPC ..... *F17C 11/005* (2013.01); *F17C 11/00* (2013.01); *F17C 11/007* (2013.01)

(58) Field of Classification Search
CPC ..... F17C 11/00; F17C 11/005; F17C 11/007; F17C 13/005; B01D 53/02; B01D 53/04
USPC ..... 95/90; 96/108, 146; 206/0.7; 502/526; 423/648.1; 429/515; 141/4
See application file for complete search history.

(56) References Cited

U.S. PATENT DOCUMENTS 4,165,569 A * 8/1979 Mackay ..... 34/416
4,187,092 A 2/1980 Woolley (Continued)

FOREIGN PATENT DOCUMENTS

CN 201363548 12/2009
CN 102188141 9/2011
DE 102007058673 6/2009

OTHER PUBLICATIONS

PCT International Search Report in PCT/IB2013/058907, mailed Mar. 20, 2014, 5 pages.

(Continued)

*Primary Examiner* — Frank Lawrence
(74) *Attorney, Agent, or Firm* — Servilla Whitney LLC

(57) ABSTRACT

Described is a method of charging a sorption store with a gas. The sorption store comprises a closed container and a feed device which has a passage through the container wall, through which the gas can flow into the container, and the container has at least two parallel, channel-shaped subchambers which are located in its interior and are each at least partly filled with an adsorption medium and whose channel walls are coolable. The method comprises, in a first step, feeding in a gas in such an amount that a pressure in the store of at least 30% of a predetermined final pressure is reached as quickly as possible and, in a second step, subsequently varying the amount of gas fed in in such a way that the course of the pressure in the store approximates the adsorption kinetics of the adsorption medium until the predetermined final pressure in the store is reached after a predetermined period of time.

9 Claims, 4 Drawing Sheets

(56) References Cited

U.S. PATENT DOCUMENTS

| | | | | |
|---|---|---|---|---|
| 4,859,427 | A * | 8/1989 | Konishi et al. | 422/159 |
| 4,964,524 | A * | 10/1990 | Halene | 220/586 |
| 6,638,348 | B2 * | 10/2003 | Kuriiwa et al. | 96/146 |
| 7,323,043 | B2 * | 1/2008 | Finamore | 96/146 |
| 7,651,554 | B2 * | 1/2010 | Tan et al. | 96/108 |
| 8,197,988 | B2 * | 6/2012 | Kim et al. | 429/515 |
| 2004/0225134 | A1 | 11/2004 | Yaghi et al. | |
| 2008/0168776 | A1 | 7/2008 | Arnold et al. | |
| 2010/0219087 | A1 * | 9/2010 | Fujita et al. | 206/0.7 |

OTHER PUBLICATIONS

DIN17458, Seamless circular austenitic stainless steel tubes subject to special requirements, Jul. 1985, 16 pages.

Zhao, Zhenxia et al., Adsorption and Diffusion of Carbon Dioxide on Metal-Organic Framework (MOF-5), *Indus. Eng. Chem. Res.*, vol. 48, No. 22, 2009, 10015-10020.

DIN17458, Seamless circular austenitic stainless steel tubes subject to special requirements, Jul. 1985, 16 pages. (German version).

* cited by examiner

METHOD OF CHARGING A SORPTION STORE WITH A GAS

CROSS-REFERENCE TO RELATED APPLICATIONS

This application claims the benefit of priority under 35 U.S.C. §119(e) to U.S. Provisional Application No. 61/711,233, filed Oct. 9, 2012, the entire content of which is incorporated herein by reference in its entirety.

TECHNICAL FIELD

The present invention relates to a sorption store for storing gaseous substances. Specifically, the present invention relates to a sorption store for storing gaseous substances, which comprises a closed container which is at least partly filled with an adsorption medium and a feed device which comprises a passage through the container wall, through which a gas can flow into the container. The invention further relates to a method of charging a sorption store with a gas, wherein the sorption store comprises a closed container and a feed device which has a passage through the container wall, through which the gas can flow into the container, and the container has at least two parallel, channel-shaped subchambers which are located in its interior and are each at least partly filled with an adsorption medium and whose channel walls are coolable.

BACKGROUND

To store gases for stationary and mobile applications, sorption stores are increasingly being used nowadays in addition to pressurized gas tanks. Sorption stores generally comprise an adsorption medium having a large internal surface area on which the gas is adsorbed and thereby stored. During filling of a sorption store, heat is liberated as a result of the adsorption and has to be removed from the store. Analogously, heat has to be supplied for the process of desorption when taking gas from the store. Heat management is therefore of great importance in the design of sorption stores.

The patent application U.S. 2008/0168776 A1 describes a sorption store for hydrogen which comprises an external container which is thermally insulated from the surroundings and in the interior of which a plurality of pressure containers comprising an adsorption medium are arranged. The intermediate spaces between the pressure containers are filled with a cooling liquid in order to be able to remove the heat evolved during adsorption.

The patent application DE 10 2007 058 673 A1 describes an apparatus for storing gaseous hydrocarbons, which comprises an insulated container filled with an adsorption medium. A heating element is provided in the container and this heating element is controlled by means of a control system in such a way that a minimum pressure is maintained over an ideally long period of time when taking off gas.

A disadvantage of known sorption stores is that filling with gas proceeds only slowly. Particularly in mobile applications, for example in motor vehicles, this disadvantage is particularly serious.

SUMMARY

A first embodiment is directed to a method of charging a sorption store with a gas, wherein the sorption store comprises a closed container and a feed device which has a passage through the container wall, through which the gas can flow into the container, and the container has at least two parallel, channel-shaped subchambers which are located in its interior and are each at least partly filled with an adsorption medium and whose channel walls are coolable, the method comprising, in a first step, feeding in a gas in such an amount that a pressure in the store of at least 30% of a predetermined final pressure is reached as quickly as possible and, in a second step, subsequently varying the amount of gas fed in in such a way that the course of the pressure in the store approximates the adsorption kinetics of the adsorption medium until the predetermined final pressure in the store is reached after a predetermined period of time.

In a second embodiment, the method of the first embodiment is modified, wherein the channel walls of the channel-shaped subchambers are configured as double walls and a heat transfer medium flows through them.

In a third embodiment, the method of the first and second embodiments is modified, wherein the spacing of the channel walls in each channel-shaped subchamber is from 2 cm to 8 cm.

In a fourth embodiment, the method of the first through third embodiments is modified, wherein the spacings of the channel walls in the channel-shaped subchambers differ by not more than 40%, in particular by not more than 20%.

In a fifth embodiment, the method of the first through fourth embodiments is modified, wherein the porosity of the adsorption medium is at least 0.2.

In a sixth embodiment, the method of the first through fifth embodiments is modified, wherein the adsorption medium is present as a bed of pellets and the ratio of the permeability of the pellets to the smallest pellet diameter is at least $10^{-14}$ $m^2/m$.

In a seventh embodiment, the method of the first through sixth embodiments is modified, wherein the adsorption medium comprises zeolite, activated carbon, or metal organic frameworks.

In an eighth embodiment, the method of the first through seventh embodiments is modified, wherein the temperature of the gas stream is measured in at least one channel-shaped subchamber and is matched to the amount of gas fed into the sorption store when required in such a way that a predetermined maximum temperature in the channel-shaped subchamber is not exceeded.

A second aspect of the invention pertains to a sorption store. A ninth embodiment is directed to a sorption store for storing gaseous substances, which comprises a closed container and a feed device which comprises a passage through the container wall, through which a gas can flow into the container, wherein the container has at least one separation element which is located in its interior and is configured so that the interior of the container is divided into at least two parallel, channel-shaped subchambers which are each at least partly filled with an adsorption medium and whose channel walls are coolable, wherein, viewed in cross section, the contours of the interior wall of the container and the at least one separation element and optionally the plurality of separation elements is/are essentially conformal.

In a tenth embodiment, the sorption store of the ninth embodiment is modified, wherein the channel walls of the channel-shaped subchambers are configured as double walls to allow a heat transfer medium to flow through them.

In an eleventh embodiment, the sorption store of the ninth and tenth embodiments is modified, wherein the spacing of the channel walls in each channel-shaped subchamber is from 2 cm to 8 cm.

In a twelfth embodiment, the sorption store of the ninth through eleventh embodiments is modified, wherein the container is cylindrical and the at least one separation element is arranged essentially coaxially to the axis of the cylinder.

In a thirteenth embodiment, the sorption store of the twelfth embodiment is modified, wherein the at least one separation element is configured as a tube so that the interior of the tube forms a first channel-shaped subchamber and the space between outer wall of the tube and inner wall of the container or optionally between outer wall of the tube and a further separation element forms a second, annular channel-shaped subchamber.

DETAILED DESCRIPTION

Figure 2:
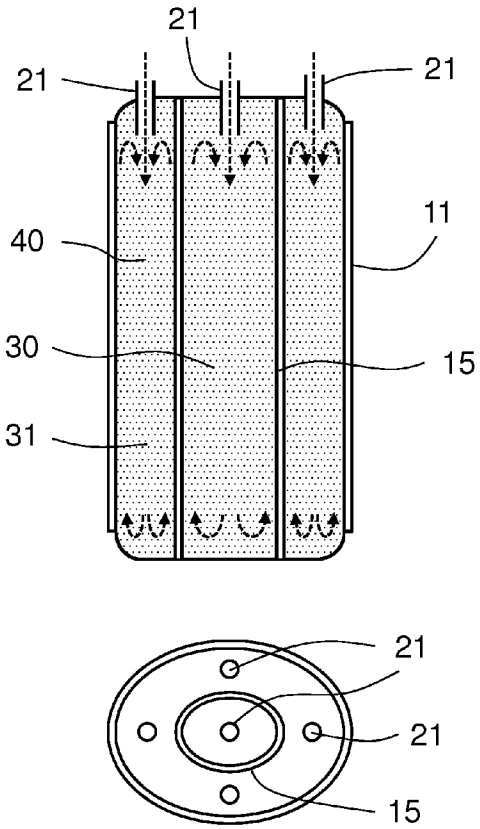
FIG. 2 depicts an embodiment of a sorption store having double channel walls, an elliptical cross-sectional area of the container and a plurality of passages.

Before describing several exemplary embodiments of the invention, it is to be understood that the invention is not limited to the details of construction or process steps set forth in the following description. The invention is capable of other embodiments and of being practiced or being carried out in various ways.

Provided is an apparatus for storing gaseous substances which allows fast charging of gas and improved taking-off of gas. The apparatus has a simple construction and requires little electric energy during operation. Further provided is a method of quickly and efficiently charging the store.

According to one or more embodiments, the method of the invention is carried out using a sorption store which comprises a closed container and a feed device which has a passage through the container wall, through which the gas can flow into the container. In one or more embodiments, the container has at least two parallel, channel-shaped subchambers which are located in its interior and are each at least partly filled with an adsorption medium and whose channel walls are coolable. In a first step of the method of the invention, gas is fed in in such an amount that a pressure in the store of at least 30% of a predetermined final pressure is reached as quickly as possible. In a subsequent second step, the amount of gas fed in is varied in such a way that the course of the pressure in the store approximates the adsorption kinetics of the adsorption medium until the predetermined final pressure in the store is reached after a predetermined period of time.

Sorption stores as are known from the prior art are, for charging, usually connected to a pressure line from which the gas to be stored flows at constant pressure into the store until a predetermined final pressure in the store has been reached. However, according to one or more embodiments, it has been found that the time required for charging can be significantly reduced when charging is carried out according to the method of the invention.

According to one or more embodiments, in the sorption store, gas is stored both by adsorption on the adsorption medium and also in the voids between and in individual particles of the adsorption medium or in regions of the container which are not filled with adsorption medium. During the first step of the method of the invention, the voids are firstly filled with gas. The pressure in the store follows, with virtually no lag time, the pressure of the gas flowing into the container. To minimize the total time required for the charging operation, this first step should be carried out as quickly as possible, for example by introducing the gas at a pressure which corresponds to at least 30% of the predetermined final pressure right from the beginning of the charging operation.

In one or more embodiments, during the first step, part of the gas is adsorbed, as a result of which the temperature of the adsorption material and thus also of the gas flowing over it increases. In the second step, the course of the pressure in the store approximates the adsorption kinetics of the adsorption medium. Methods of determining the adsorption kinetics are known to those skilled in the art, for example by means of pressure jump experiments or adsorption balances (e.g. in "Zhao, Li and Lin, Industrial & Engineering Chemistry Research, 48(22), 2009, pages 10015-10020").

As used herein, the term adsorption kinetics refers to the course of the adsorption of the gas on the adsorption medium over time under isothermal and isobaric conditions. This course can frequently be approximated by an exponentially decaying function, which, at the beginning, displays a sharp rise and then becomes ever flatter as it converges toward a final value. An example of such an approximation is the function $a\cdot(1-e^{-bt})$, where a and b are positive constants. The adsorption kinetics can also be approximated by other functions, for example a concave function, a function which is constant in sections, a function which is linear in sections, or a linear function which joins the initial value and the final value.

The actual flow conditions in the channel-shaped subchambers of the store depend on the configuration of the channels and on the introduction of gas into the channels. In a specific variant of sorption stores according to the invention, the channel-shaped subchambers are closed at one end. This is, for example, the case when the separation elements are joined to the interior wall of the container at one end. In this variant, the gas flowing into the container is advantageously conducted to the open ends of the channel-shaped subchambers. In the channels, part of the gas becomes adsorbed on the adsorption medium, as a result of which the adsorption medium and the surrounding gas heat up. The interior wall of the container and the at least one separation element or the plurality of separation elements optionally present are cooled, so that a radial temperature gradient is formed between the middle of the channel-shaped subchambers and their peripheries. The second step of the feed strategy of the invention in particular introduces a continual stream of gas into the container. Circulating gas flows are established internally in the channel-shaped subchambers by interaction with the radial temperature gradient and these ensure significantly better heat removal and thus lower maximum temperatures in the adsorption medium.

In a further variant of energy stores according to the invention, the channel-shaped subchambers are open at both ends and are connected pairwise with one another via common spaces. In this variant, the feed device is preferably configured so that inflowing gas is directed virtually exclusively into one of the two subchambers of each channel pair. The charging strategy according to the invention with a course of the pressure in the store which approximates the adsorption kinetics results in the flow rate of the gas in the channel-shaped subchambers being greater than the speed at which the gas is adsorbed. This results in the formation of circulating flows through the channel-shaped subchambers which ensure that the heat evolved during adsorption can be removed more quickly and lower maximum temperatures are established in the adsorption medium.

Compared to the conventional feed strategy, in which the pressure is kept constantly high over the entire charging time, the method of the invention allows, during charging, larger amounts of gas to be introduced in the same time or shorter charging times to be achieved at the same amounts of gas.

The amount of gas fed in can, for example, be varied by matching the inlet pressure appropriately to the approximation function, e.g. by means of appropriate valve connections.

In an advantageous embodiment of the method of the invention, the course of the pressure in the store approximates the adsorption kinetics in the form of pressure oscillations, in particular as a result of appropriate variation of the inlet pressure. In one or more embodiments, the maximum value of the oscillation corresponds to the final pressure and the minimum value of the oscillation preferably approximates the course of the adsorption kinetics. This corresponds to a reduction in the oscillation amplitude over time. At the end of the predetermined period of time, the predetermined final pressure in the store is set. The oscillation can be, for example, sinusoidal, sawtooth-shaped or alternately constant in sections. The shape of the oscillation and also its amplitude and period are matched to the specific adsorption kinetics.

An example of a function which approximates the pressure oscillation of the adsorption kinetics is:

$$p=p0+\Delta p\cdot f(a)\cdot(\sin(2\cdot\pi\cdot k\cdot t)-1),\text{where}$$

$p_0$ is the initial pressure, p is the difference between initial pressure and final pressure, k is the frequency and f(a) is a damping function. The damping can, for example, decrease linearly or decrease exponentially. An example is the function f(a)=a/(t+a), where a is a positive number. The frequency k can be estimated via the isothermal and isobaric adsorption kinetics $t_{kin}$, which is a measure of the minimum charging time. The frequency is preferably selected so that from two to ten oscillation periods are located within $t_{kin}$. At a greater number of cycles, less heat can be removed per cycle, so that the energy consumption required for providing the pressure oscillations becomes uneconomical.

The time required for filling a sorption store is influenced substantially by the materials properties of the adsorption medium, in particular its adsorption kinetics. A further influencing factor is the maximum temperature to be expected during filling, which likewise depends on the materials properties, in particular the enthalpy of adsorption. According to one or more embodiments, the choice of the initial pressure and of the type of pressure increase are matched to the respective adsorption kinetics, the enthalpy of adsorption and the heat conduction to the walls. In the case of rapid heat removal of the enthalpy of adsorption liberated, relatively high initial pressures are advantageous in order to minimize the total charging time required. Depending on the adsorption kinetics and heat removal, initial pressures in the range from 30% to 90% of the predetermined final pressure are advantageous, with an ideally high initial pressure being selected. The magnitude of the initial pressure may be limited by the temperature increase established during adsorption.

In one or more embodiments, it tends to be advantageous to select a greater pressure difference between initial pressure and final pressure, the slower the removal of heat. In one or more embodiments, the rate at which the pressure is increased is at least 1 bar per minute of charging time in order to promote the formation of a circulating flow in the channel-shaped subchambers.

In a specific embodiment of the method of the invention, the temperature of the gas stream is measured in at least one channel-shaped subchamber and matched, if required, to the amount of gas fed into the sorption store in such a way that a predetermined maximum temperature in the channel-shaped subchamber is not exceeded.

Various materials are suitable as adsorption medium. The adsorption medium preferably comprises zeolite, activated carbon or metal organic frameworks.

The porosity of the adsorption medium is preferably at least 0.2. The porosity is defined as the ratio of void volume to total volume of any subvolume in the container. At a low porosity, the pressure drop on flowing through the adsorption medium increases, which has an adverse effect on the charging time.

In a specific embodiment of the invention, the adsorption medium is present as a bed of pellets and the ratio of permeability of the pellets to the smallest pellet diameter is at least $10^{-14}$ $m^2/m$. The rate at which the gas penetrates into the pellets during charging depends on the speed at which the pressure in the interior of the pellets approaches the pressure on the outside of the pellets. The time required for this pressure equalization and thus also the loading time of the pellets increases with decreasing permeability and with increasing diameter of the pellets. This can have a limiting effect on the total process of charging and discharging.

In one or more embodiments, the time required for charging can be reduced further when the gas is cooled before being introduced.

According to one or more embodiments, the at least one separation element or a plurality of separation elements, in particular all separation elements present, have a double wall so that a heat transfer medium can flow through them. In one or more embodiments, preference is given to all channel walls of the channel-shaped subchambers being double walls to allow a heat transfer medium to flow through them. Depending on the arrangement of the at least one separation element or the plurality of separation elements, a section of the interior wall of the container forms a channel wall of a channel-shaped subchamber or a plurality of channel-shaped subchambers. In this case too, the container wall is a double wall. In a specific embodiment, the entire container wall including the end faces is configured so as to allow a heat transfer medium to flow through it, in particular configured as a double wall.

Depending on the temperature range which is suitable for the cooling or heating of the gas in the sorption store, various heat transfer media, for example water, glycols, alcohols or mixtures thereof, are possible. Appropriate heat transfer media are known to those skilled in the art.

It has been found to be advantageous for the spacing of the channel walls in each channel-shaped subchamber to be from 2 cm to 8 cm. As used herein, the term spacing refers to the shortest distance between two points on opposite walls viewed in cross section perpendicular to the axis of the channel. In the case of a channel having a circular cross section, for example, the spacing corresponds to the diameter, in the case of an annular cross section it corresponds to the width of the annulus and in the case of a rectangular cross section it corresponds to the shorter distance between the parallel sides. Particularly when all channel walls are cooled or heated, the range mentioned has been found to be a good compromise between heat transfer and fill volume of the adsorption medium. At greater spacings, heat transfer between adsorption medium and wall deteriorates, and in the case of smaller spacings, the fill volume of the adsorption medium at given external dimensions of the container decreases. In addition, the weight of the sorption store and its production costs increase, which is disadvantageous, in particular in the case of mobile applications.

In a specific embodiment, the spacings of the channel walls in the channel-shaped subchambers differ by not more than 40%, specifically by not more than 20%. Such a configuration aids uniform removal of heat during charging and introduction of heat during emptying of the container.

In one or more embodiments, the container of the sorption store is cylindrical and the at least one separation element is arranged essentially coaxially to the axis of the cylinder. Embodiments in which the longitudinal axis of the at least one separation element is inclined by a few degrees up to a maximum of 10 degrees relative to the axis of the cylinder are considered to be "essentially" coaxial. This configuration ensures that the channel cross sections vary only slightly along the axis of the cylinder, so that uniform flow over the length of the channel can be established.

Depending on the space available for installation and the maximum permissible pressure in the container, various cross-sectional areas for the cylindrical container are possible, for example circular, elliptical or rectangular. Irregularly shaped cross-sectional areas are also possible, e.g. when the container is to be fitted into a hollow space of a vehicle body. Circular and elliptical cross sections are particularly suitable for high pressures above about 100 bar.

According to one or more embodiments, the invention further provides a sorption store for storing gaseous substances, which comprises a closed container and a feed device which comprises a passage through the container wall, through which a gas can flow into the container. The container has at least one separation element which is located in its interior and is configured so that the interior of the container is divided into at least two parallel, channel-shaped subchambers which are each at least partly filled with an adsorption medium and whose channel walls are coolable. According to the invention, viewed in cross section, the contours of the interior wall of the container and the at least one separation element and optionally the plurality of separation elements is/are essentially conformal.

As used herein, the term conformal means that the contours have the same shape, for example all circular, all elliptical, or all rectangular. As used herein, the phrase "essentially conformal" means that small deviations from the basic shape are still encompassed by "the same shape". Examples are round corners in the case of a rectangular basic shape or deviations within manufacturing tolerances.

Such a configuration allows optimal utilization of the interior space of the container with a view to a very large amount of adsorption medium combined with efficient heating management.

The above-described preferred structural features such as the double-walled separation elements, spacings of the channel walls and/or the coaxial arrangement of the separation elements in a cylindrical container also represent specific embodiments of the sorption store of the invention.

In one or more embodiments, the choice of the wall thickness of the container and of the separation elements depends on the maximum pressure to be expected in the container, the dimensions of the container, in particular its diameter, and the properties of the material used. In the case of an alloy steel container having an external diameter of 10 cm and a maximum pressure of 100 bar, the minimum wall thickness has, for example, been estimated at 2 mm (in accordance with DIN 17458). The internal spacing of the double walls is selected so that a sufficiently large volume flow of the heat transfer medium can flow through them. It is preferably from 2 mm to 10 mm, particularly preferably from 3 mm to 6 mm.

In one or more embodiments, the at least one separation element is configured as a tube so that the interior space of the tube forms a first channel-shaped subchamber and the space between the outer wall of the tube and the interior wall of the container or optionally between the outer wall of the tube and a further separation element forms a second, annular channel-shaped subchamber. The contour of the tubular separation element viewed in cross section is conformal with the contour of the interior wall of the container; they are, for example, both circular or both elliptical. In a further development of this embodiment according to the invention, a plurality of separation elements are present and are all configured as tubes having various diameters and are arranged coaxially. Their contours viewed in cross section are likewise conformal with the contour of the interior wall of the container.

According to one or more embodiments, the feed device comprises at least one passage through the container wall, through which a gas can flow into the container. In one or more embodiments, the feed device comprises a tubular feed line whose one end is connected to the at least one passage and which branches into a plurality of ends which open into the respective channel-shaped subchambers. In an alternative embodiment, the feed device comprises a plurality of passages through the container wall which are all connected at one end to a tubular feed line whose other end opens into the channel-shaped subchambers.

In a further advantageous embodiment, the feed device comprises components which divide the gas flowing in through the at least one passage in a specific way over all subchambers, e.g. a deflection element or a distribution device.

In one or more embodiments, the inflowing amount of gas is distributed over the channel-shaped subchambers in such a way that the ratios of the individual amounts of gas to one another correspond to the ratios of the cross-sectional areas of the subchambers.

In one or more embodiments, the feed device can also comprise means of influencing the gas flow, for example throttle valves or regulating valves. These means can be provided within or outside the container. It is also possible for a plurality of passages to be provided in the container wall, for example in order to introduce the gas into the channel-shaped subchambers in a plurality of places or to provide different passages for filling and for taking off gas. In one or more embodiments, preference is given to using the same passage or passages for taking off gas as for filling the container.

Compared to the prior art, the sorption store of the invention makes faster heat transport from the adsorption medium or into the adsorption medium possible. This significantly decreases the time required for charging of the store with a given amount of gas. As an alternative, the store can be charged with a larger amount of gas in a given time. When taking gas from the store, the invention makes rapid and constant provision of gas possible. For this purpose, the channel walls are heated, for example in the case of the double-walled configuration a heat transfer medium whose temperature is greater than the temperature of the gas in the channel-shaped subchambers is passed through the double wall. The sorption store of the invention is simple to construct and as a result of its compact construction is particularly suitable for mobile applications, for example in motor vehicles. The embodiment with double channel walls has the additional advantage that the heat transfer medium merely has to be changed or its temperature altered appropriately to change from cooling or heating. This embodiment is therefore suitable for mobile use both during filling and in the driving mode.

The invention is illustrated below with the aid of the drawings; the drawings are to be interpreted as in-principle depictions. They do not restrict the invention, for example in respect of specific dimensions or configurational variants of components. In the interest of clarity, they are generally not to scale, especially in respect of length and width ratios.

LIST OF REFERENCE NUMERALS USED IN THE FIGURES

Figure 1:
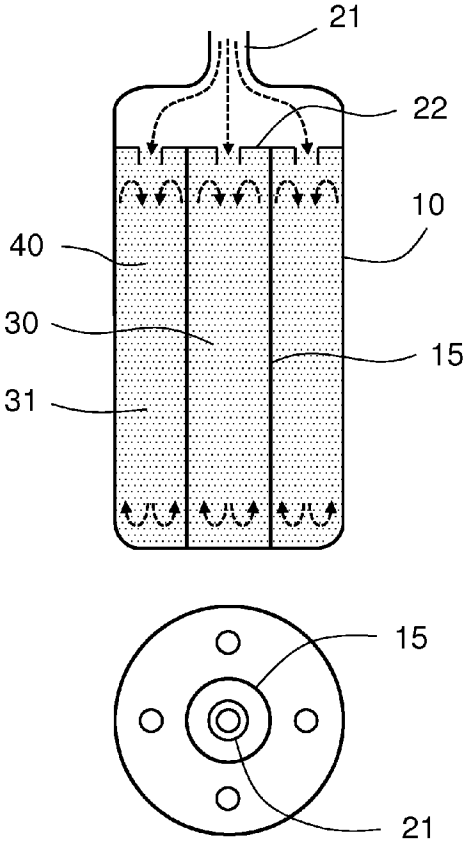
FIG. 1 depicts an embodiment of a sorption store having a flow equalizer for inflowing gas.
Figure 3:
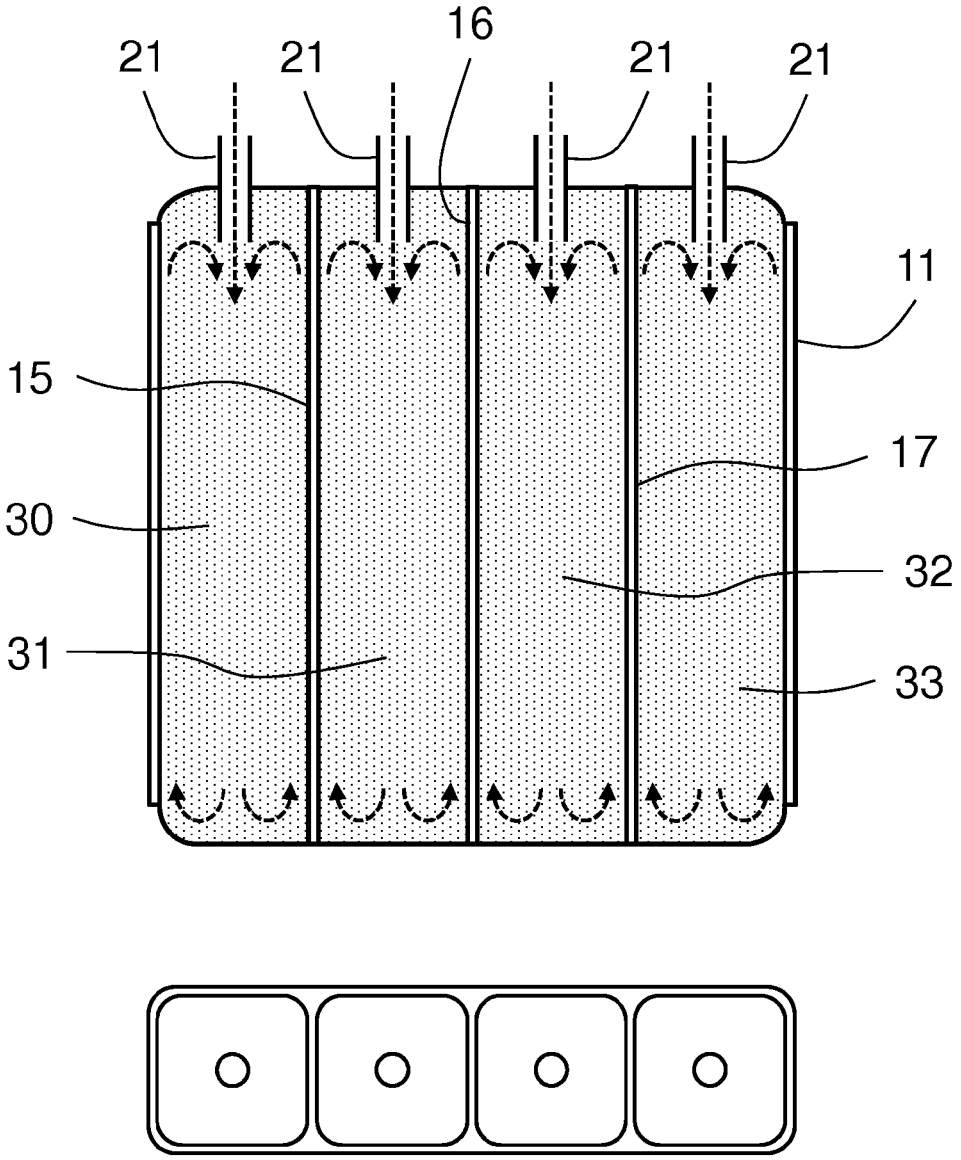
FIG. 3 depicts an embodiment of a sorption store having a rectangular cross section of the container.

10 . . . Container
11 . . . Container wall
15 . . . Separation element
16 . . . Separation element
17 . . . Separation element
21 . . . Passage
22 . . . Covering plate
30 . . . First subchamber
31 . . . Second subchamber
32 . . . Third subchamber
33 . . . Fourth subchamber
40 . . . Adsorption medium
5*x* . . . Process steps for determining the initial pressure FIGS. 1 to 3 show schematic sections through sorption stores according to the invention. The illustrative sorption stores have an essentially cylindrical container 10. The upper drawings in each case depict longitudinal sections through the axis of the cylinder, and the drawings underneath each of these show corresponding cross sections perpendicular to the axis of the cylinder.

FIG. 1 shows an embodiment of a sorption store according to the invention. Referring to FIG. 1, the container 10 has a circular cross section and at its end faces has a passage 21 through the container wall. A separation element 15 which is configured as a tube having a circular cross section and is arranged coaxially to the axis of the cylinder is located in the interior of the container 10. The interior space of the tube forms a first channel-shaped subchamber 30. The space between the outer wall of the tube and the interior wall of the container forms a second, annular channel-shaped subchamber 31. The separation element 15 has a spacing from the inlet-end end face; at the opposite end it extends to the end face of the container. In the example shown, the two subchambers 30, 31 are completely filled with an adsorption medium 40. At the end facing the passage 21, the subchambers 30, 31 are bounded by a covering plate 22 which extends over the entire cross section of the container. In the example shown, five openings through which gas can flow into the subchambers are present in the covering plate 22. The covering plate functions as flow equalizer which ensures uniform flow of gas into the subchambers 30, 31. The openings shown are by way of example; they can also have another configuration. For example, annular or interrupted annular openings can be provided in the outer region which connects the passage 21 to the second subchamber 31.

The broken-line arrows symbolize the gas flow within the container. Inflowing gas firstly goes into the space which is not filled with adsorption medium between the passage 21 and the covering plate 22 and becomes uniformly uniform distributed there. The gas flows through the openings in the covering plate into the two subchambers 30, 31 where it is adsorbed on the adsorption medium. The adsorption medium and the surrounding gas heat up as a result of the adsorption. The interior wall of the container 10 and the separation element 15 are cooled so that a radial temperature gradient is established between the middle of the channel-shaped subchambers and their peripheries. The second step of the feed strategy according to the invention, in particular, brings about continual gas flow into the container. In one or more embodiments, interaction of this with the radial temperature gradient results in circulating gas flows which ensure significantly better heat removal and thus lower maximum temperatures in the adsorption medium being established internally in the channel-shaped subchambers 30, 31. As a result, the container can be loaded with the same amount of gas in a shorter time than in the case of the conventional feed strategy in which the pressure is kept constantly high over the entire charging time.

FIG. 2 shows a further embodiment of a sorption store according to the invention. Referring to FIG. 2, the container 10 has an elliptical cross section and a tubular separation element 15 which likewise has an elliptical cross section is arranged coaxially to the axis of the cylinder in the interior of the container. As in the previous example, the interior space of the tubular separation element 15 forms a first channel-shaped subchamber 30 and the space between the outer wall of the tube and the interior wall of the container forms a second, annular channel-shaped subchamber 31. The channel walls of the channel-shaped subchambers 30 and 31, which are formed by the container wall 11 and the separation element 15, have double walls so that a heat transfer medium can flow through the walls. Corresponding feed connections and discharge connections for a heat transfer medium are provided but are not shown in the figure.

In this example, the entire interior volume of the container is filled with adsorption medium 40. The feed device comprises five passages 21 through the container wall, through which gas can flow into the interior of the container. The passages 21 are located at one end face of the container 10, are configured as tubes and are arranged uniformly around the circumference in the region of the annular, outer subchamber 31 and also centrally in the middle of the end face as inlet into the interior subchamber 30. In this embodiment, the separation element 15 extends at both ends to the respective end face of the container.

The broken-line arrows symbolize the gas flow within the container. In this example, the inflowing gas is distributed directly over the adsorption medium through the five passages 21. The formation of a temperature gradient and the gas flow circulating internally in the subchambers 30, 31 occurs analogously to the example described above for FIG. 1.

FIG. 3 shows a further preferred embodiment of a sorption store according to the invention. Referring to FIG. 3, the container has a cylindrical shape and an essentially rectangular cross section. The corners are rounded, and the container wall 11 is a double wall to allow a heat transfer medium to flow through it. The interior of the container is divided by three separation elements 15, 16, 17 into four channel-shaped subchambers 30 to 33. The separation elements are uniformly distributed in the longitudinal direction of the container, so that the subchambers likewise have rectangular cross sections with essentially identical internal areas. In the example shown, the cross sections of the subchambers are square with rounded corners. The separation elements are configured as double-walled plates and in the longitudinal direction run coaxially to the axis of the cylinder and in the transverse direction parallel to the interior container wall of the container opposite or parallel to the adjacent separation elements. The contours of the interior wall of the container and the separation elements viewed in cross section are thus conformal. In the axial direction and in the transverse direction, the separation elements each extend to the interior wall of the container and are joined thereto, so that four completely separate subchambers are obtained in the container.

A passage 21 through which gas can flow into the container is provided through an end face of the wall of the container for each subchamber 30, 31, 32, 33. The passages 21 are tubular and extend into the respective subchamber. All channel-shaped subchambers are filled with an adsorption medium.

In this figure (FIG. 3), too, the broken-line arrows symbolize the gas flow in the container. In a manner analogous to the embodiment of FIG. 2, the inflowing gas is distributed over the adsorption medium directly through the passages 21. Owing to the cooling of the channel walls, a temperature gradient from the middle of the channel to the channel walls when viewed in cross section is established. As described in respect of FIG. 1, the feed strategy according to the invention brings about a continual gas flow into the container and in combination with the temperature gradient results in gas flows circulating internally in the channel-shaped subchambers 30, 31, 32, 33, giving the above-described advantages.

To improve heat transfer, further components for transferring heat, e.g. a central tube in each subchamber 30, 31, 32, 33 running along the axis of the cylinder in each case, can also be provided. Of course, such measures can also be advantageous in embodiments other than that shown in FIG. 3.

Figure 4:
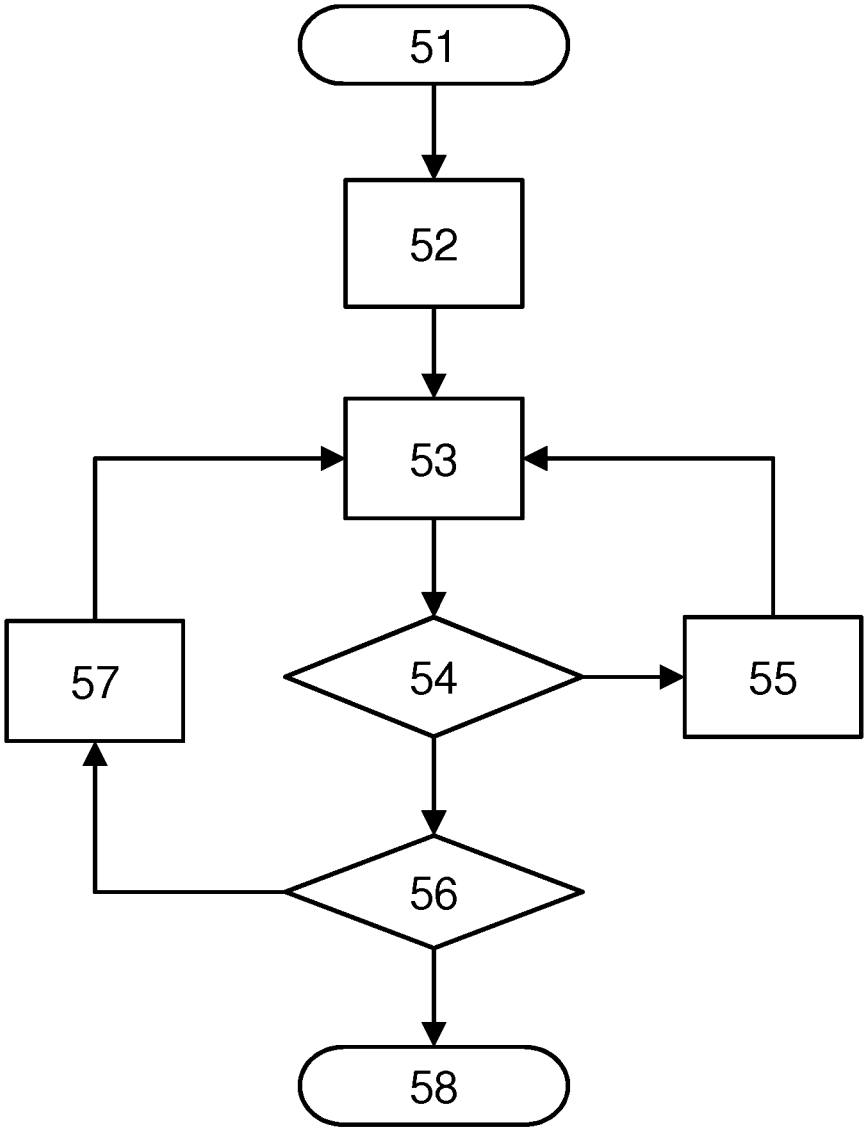
FIG. 4 is an example of a flow diagram for determining the initial pressure for charging a sorption store.

FIG. 4 shows, by way of example, a flow diagram for determining the initial pressure $p_0$ for the charging according to the invention of a sorption store. Referring to FIG. 4, after the beginning 51 a starting value for the initial pressure $p_0$, for example 50% of the final pressure to be reached, is firstly selected in the initialization phase 52. Furthermore, an upper limit for the temperature $T_{max}$ permissible in the store and also the desired end time $t_e$ of filling, e.g. five minutes, are set down.

Step 53 comprises the actual carrying out of the experiment. An empty sorption store is charged with gas whose pressure at the inlet to the store is a constant $p_0$ from the starting point in time to the point in time $t_0$ which is, for example, set at one minute. Over the period of time from $t_0$ to the end time $t_e$, the pressure at the inlet of the store is increased according to a predetermined function which approximates the course of the adsorption kinetics of the adsorption medium used.

The maximum temperature reached during the loading operation in step 54 is compared with the predetermined upper limit $T_{max}$. If the upper limit is exceeded, the initial pressure $p_0$ is reduced, for example by a predetermined value, a predetermined percentage or as interval nesting, in step 55. However, the pressure should not go below the minimum pressure amounting to 30% of the final pressure. A renewed experiment (step 53) using the reduced initial pressure is subsequently carried out.

However, if the predetermined upper temperature limit $T_{max}$ is not reached, a check is carried out in the next step 56 as to whether the total loading of the store with gas is satisfactory at the end time $t_e$. The criterion can, for example, be a total loading of at least 95% of the maximum uptake capacity. If the loading is still not satisfactory, a further iteration in which the initial pressure $p_0$ is increased in step 57 is carried out. The pressure can be increased, for example, by a predetermined value, a predetermined percentage or as interval nesting. A renewed experiment (step 53) using the increased initial pressure is subsequently carried out.

If the temperature criterion (step 54) is adhered to and the total loading is also satisfactory, the experimental program is ended (step 58). In this way, an optimal value for the initial pressure can be determined in a few, targeted experiments. The experiments are easy to carry out and are required only once for design of an actual sorption store. In an analogous way, or in combination with the above-described sequence, the feed strategy can be set down or optimized from the initial pressure to the final pressure.

The invention is now described with reference to the following examples.

EXAMPLES

Results of simulation calculations carried out using the program OpenFOAM (from ENGYS) are shown below. The calculations are based on the following assumptions:

- The bed of pellets can be regarded as a porous medium and as a homogeneous phase separate from the gas phase. It is thus not necessary for each individual pellet to be numerically resolved.
- All pellets have the same properties in respect of size, permeability, density, heat capacity, conductivity, enthalpy of adsorption and adsorption kinetics.
- The flow effects in respect of the heat conduction of the bed can be described by known correlations.

The calculations are based on a cylindrical container having a circular cross section, an internal length extension of 100 cm and an internal diameter of 17 cm. In the interior of the container, a tube having a circular cross section is installed as separation element concentrically to the axis of the cylinder. It has a double wall and an internal diameter of 5 cm. Its wall thickness is a total of 1 cm, and the gap width between the walls of the double wall is 3 mm. The configuration corresponds to that of the example as per FIG. 2 but with a circular cross section. The interior of the container is thus divided into two parallel, channel-shaped subchambers which are completely separate from one another. The spacings of the channel walls are 5 cm in both subchambers. The container wall is likewise a double wall having a wall thickness of a total of 1 cm, and the gap width between the walls of the double wall is 3 mm. The tubes connected to the passages 21 project 8 cm into the container.

The container has a fill volume of 19 liters and is filled with pellets of a metal organic framework (MOF) of the type 177 as adsorption medium. The MOF type 177 comprises zinc clusters which are joined via 1,3,5-tris(4-carboxyphenyl)benzene as organic linker molecule. The specific surface area (Langmuir) of the MOF is in the range from 4000 to 5000 $m^2/g$. Further information on this type may be found in U.S. Pat. No. 7,652,132 B2. The pellets have a cylindrical shape with a length of 3 mm and a diameter of 3 mm. Their permeability is $3 \cdot 10^{-16}$ $m^2$. The ratio of permeability to smallest pellet diameter is thus $10^{-13}$ $m^2/m$. The porosity of the bed is 0.47.

The filling of the container with pure methane, which is fed in with a temperature of 27° C., is examined. The predetermined final pressure is 90 bar absolute. A heat transfer medium flows through the container wall and the respective separation elements in such a way that a constant wall temperature of 27° C. is established. Under these conditions, the container can be filled with a maximum of 2 kg of methane.

Figure 5:
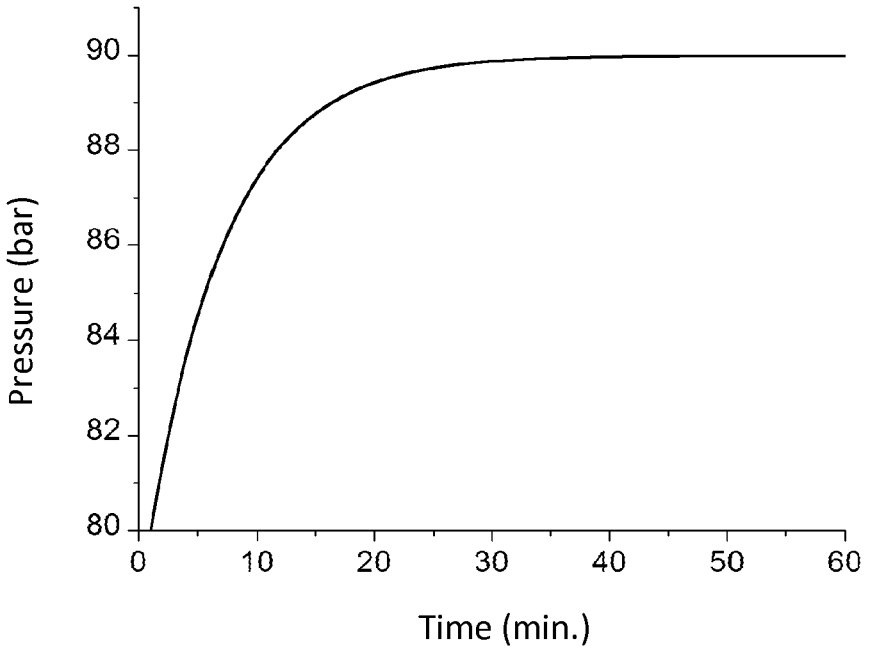
FIG. 5 is a comparison of the charging strategy according one or more embodiments with conventional charging strategy.
Figure 5:
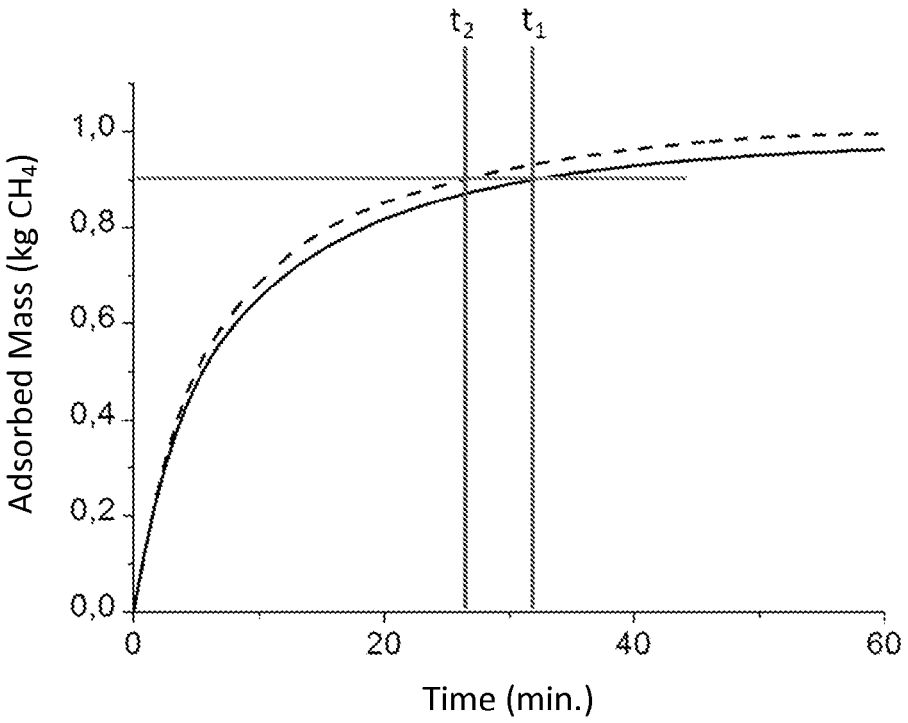

The lower graph in FIG. 5 shows the results of two scenarios. In the comparative scenario (solid curve), the gas is fed into the above-described container at a constant pressure of 90 bar from the beginning. The final pressure of 90 bar is reached in the container within the first minute. After about 32 minutes, 0.9 kg of methane has been adsorbed (time $t_1$ in FIG. 5). At this point in time, the voids of the bed of pellets have been filled with a further kilogram of methane, so that the container is loaded to an extent of 95% with methane.

In the scenario according to the invention (broken curve), the same container configuration as in the comparative scenario is used as a basis. However, the gas is fed in at only 80 bar for a time of one minute at the beginning until the internal pressure in the container has risen to 80 bar. The inlet pressure of the methane fed in is subsequently increased over a time of 30 minutes to the final pressure of 90 bar according to a function matched to the adsorption kinetics:

$$p(t)=p_0+\Delta p\cdot(1-e^{-kt})$$

where $p_0$=80 bar, $\Delta p$=10 bar and k=0.0025 $s^{-1}$.

The course of the pressure over time is shown in the upper graph in FIG. 5. In the case of the tank under consideration, the simulated MOF type displays heat removal which is fast relative to the adsorption kinetics, and a value of about 90% of the final pressure is therefore selected as initial pressure. A major part of the methane to be adsorbed is adsorbed within the first minutes. This results in a sharp rise in the temperature of the adsorption medium.

The simulation results demonstrate that a flow circulating internally in the channel-shaped subchambers is induced by means of this mode of operation according to the invention. As a result of the flow, the heat evolved in the adsorption medium as a result of the adsorption is removed more quickly at the cooled walls. This in turn leads to the adsorption occurring more quickly and the container being loaded to an extent of 95% with methane after only about 26 minutes (time $t_2$ in the lower graph in FIG. 5).

All references, including publications, patent applications, and patents, cited herein are hereby incorporated by reference for all purposes to the same extent as if each reference were individually and specifically indicated to be incorporated by reference and were set forth in its entirety herein.

The use of the terms "a" and "an" and "the" and similar referents in the context of describing the materials and methods discussed herein (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the materials and methods and does not pose a limitation on the scope unless otherwise claimed. No language in the specification should be construed as indicating any non-claimed element as essential to the practice of the disclosed materials and methods.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims.

What is claimed is:

1. A method of charging a sorption store with a gas, wherein the sorption store comprises a closed container and a feed device which has a passage through the container wall, through which the gas can flow into the container, and the container has at least two parallel, channel-shaped subchambers which are located in its interior and are each at least partly filled with an adsorption medium and whose channel walls are coolable, the method comprising, feeding in a gas in such an amount that a pressure in the store of at least 30% of a predetermined final pressure is reached as quickly as possible and, subsequently varying the amount of gas fed in in such a way that the course of the pressure in the store approximates the adsorption kinetics of the adsorption medium until the predetermined final pressure in the store is reached after a predetermined period of time.

2. The method according to claim 1, wherein the channel walls of the channel-shaped subchambers are configured as double walls and a heat transfer medium flows through them.

3. The method according to claim 1, wherein the spacing of the channel walls in each channel-shaped subchamber is from 2 cm to 8 cm.

4. The method according to claim 1, wherein the spacings of the channel walls in the channel-shaped subchambers differ by not more than 40%, in particular by not more than 20%.

5. The method according to claim 1, wherein the porosity of the adsorption medium is at least 0.2.

6. The method according to claim 1, wherein the adsorption medium is present as a bed of pellets and the ratio of the permeability of the pellets to the smallest pellet diameter is at least $10^{-14}$ $m^2/m$.

7. The method according to claim 1, wherein the adsorption medium comprises zeolite, activated carbon, or metal organic frameworks.

8. The method according to claim 1, wherein the temperature of the gas stream is measured in at least one channel-shaped subchamber and is matched to the amount of gas fed into the sorption store when required in such a way that a predetermined maximum temperature in the channel-shaped subchamber is not exceeded.

9. The method of claim 1, wherein the at least two parallel, channel-shaped subchambers are closed at one end.

* * * * *